US010280387B2

(12) United States Patent
Reinoso Garcia et al.

(10) Patent No.: US 10,280,387 B2
(45) Date of Patent: May 7, 2019

(54) AQUEOUS FORMULATIONS, THEIR MANUFACTURE AND USE

(71) Applicant: BASF SE, Ludwigshafen (DE)

(72) Inventors: Marta Reinoso Garcia, Dossenheim (DE); Markus Hartmann, Neustadt (DE); Birgit Potthoff-Karl, Gruenstadt (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 15/546,312

(22) PCT Filed: Feb. 1, 2016

(86) PCT No.: PCT/EP2016/052020

§ 371 (c)(1),
(2) Date: Jul. 26, 2017

(87) PCT Pub. No.: WO2016/124516

PCT Pub. Date: Aug. 11, 2016

(65) Prior Publication Data

US 2018/0016527 A1 Jan. 18, 2018

(30) Foreign Application Priority Data

Feb. 3, 2015 (EP) ..... 15153658

(51) Int. Cl.

| | |
|---|---|
| ***C11D 3/33*** | (2006.01) |
| ***C11D 3/37*** | (2006.01) |
| ***C11D 3/40*** | (2006.01) |
| ***C11D 17/04*** | (2006.01) |
| ***B08B 3/04*** | (2006.01) |
| ***C11D 3/20*** | (2006.01) |
| ***C11D 3/34*** | (2006.01) |
| ***C11D 7/26*** | (2006.01) |
| ***C11D 7/32*** | (2006.01) |
| ***C11D 17/00*** | (2006.01) |
| ***C11D 3/16*** | (2006.01) |

(52) U.S. Cl.

CPC ..... *C11D 3/40* (2013.01); *C11D 3/168* (2013.01); *C11D 3/2086* (2013.01); *C11D 3/33* (2013.01); *C11D 3/3409* (2013.01); *C11D 3/3418* (2013.01); *C11D 3/3753* (2013.01); *C11D 3/3765* (2013.01); *C11D 7/265* (2013.01); *C11D 7/3245* (2013.01); *C11D 17/003* (2013.01); *C11D 17/043* (2013.01); *C11D 17/045* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,730,645 | B1 | 5/2004 | Foley et al. | |
| 2005/0288207 | A1 | 12/2005 | Sadlowski et al. | |
| 2008/0234169 | A1 | 9/2008 | Boutique et al. | |
| 2008/0242569 | A1 * | 10/2008 | Carter | C11D 3/40 510/100 |
| 2013/0245242 | A1 | 9/2013 | Torres et al. | |
| 2014/0371435 | A9 | 12/2014 | Torres et al. | |
| 2016/0221931 | A1 | 8/2016 | Reinoso Garcia et al. | |

OTHER PUBLICATIONS

Extended European Search Report dated Jul. 22, 2015 in Patent Application No. 15153658.8.
International Search Report and Written Opinion dated Apr. 20, 2016 in PCT/EP2016/052020 (submitting Written Opinion only, International Search Report previously filed on Aug. 3, 2017).
International Search Report dated Apr. 20, 2016 in corresponding PCT/EP2016/052020.

* cited by examiner

*Primary Examiner* — Brian P Mruk
(74) *Attorney, Agent, or Firm* — Oblon, McClelland, Maier & Neustadt, L.L.P.

(57) ABSTRACT

Aqueous formulation containing (A) at least one pigment or at least one dyestuff, (B) at least one dispersant selected from (B1) copolymers of at least one ethylenically unsaturated $C_4$-$C_{10}$-dicarboxylic acid and at least one $C_4$-$C_{20}$-olefin and their respective alkali metal salts and (B2) aromatic sulfonic acids and their respective alkali metal salts. (C) at least one chelating agent selected from MGDA, GLDA, IDS and citric acid and their respective ammonium and alkali metal salts. (D) water, wherein the concentration of the pigment (A) or dyestuff (A) is in the range of from 5 to 500 ppm, referring to the total aqueous formulation, and wherein the weight ratio of dispersant (B) to the pigment (A) or dyestuff (A), respectively, is in the range of from 1:5 to 3:1.

15 Claims, No Drawings

AQUEOUS FORMULATIONS, THEIR MANUFACTURE AND USE

The present invention is directed towards an aqueous formulation containing (A) at least one pigment or at least one dyestuff, (B) at least one dispersant selected from (B1) copolymers of at least one ethylenically unsaturated $C_4$-$C_{10}$-dicarboxylic acid and at least one $C_4$-$C_{20}$-olefin, and their respective alkali metal salts, and (B2) aromatic sulfonic acids and their respective alkali metal salts, (C) at least one chelating agent selected from MGDA, GLDA, IDS and citric acid and their respective ammonium and alkali metal salts, (D) water, wherein the concentration of the pigment (A) or dyestuff (A) is in the range of from 5 to 500 ppm, referring to the total aqueous formulation and wherein the weight ratio of dispersant (B) to the pigment (A) or dyestuff (A), respectively, is in the range of from 1:5 to 3:1.

Chelating agents are required for many applications where salts from calcium and/or magnesium are to be removed from water. Examples are hard surface cleaning compositions that work under alkaline conditions such as, but not limited to automatic dishwashing compositions, and furthermore fabric cleaning compositions such as, but not limited to laundry cleaning compositions. Chelating agents such as methyl glycine diacetic acid (MGDA) and glutamic acid diacetic acid (GLDA) and their respective alkali metal salts are useful and environmentally friendly sequestrants for alkaline earth metal ions such as $Ca^{2+}$ and $Mg^{2+}$. They can replace phosphate-type sequestrants such as sodium tripolyphosphate ("STPP"), the latter being replaced now in many countries for environmental reasons. Therefore, MGDA and related compounds are recommended and used for various purposes such as laundry detergents and for automatic dishwashing (ADW) formulations, in particular for so-called phosphate-free laundry detergents and phosphate-free ADW formulations. For shipping such chelating agents, in most cases solids such as granules are being applied or gels or aqueous solutions.

For automatic dishwashing and laundry care, so-called unit doses are of increased commercial importance. They are of great convenience for the end-user because such unit doses contain the right amounts of the ingredients for the washing and rinsing steps and because they can be easily placed into the automatic dishwasher or washing machine by the end-user, see, e.g., WO 2002/042400 and WO 2011/072017. Examples of unit doses are tablets and pellets and in particular pouches. Pouches in the form of multi-compartment pouches have been disclosed as well, see WO 2009/112994.

Important types of formulations of formulations for automatic dishwashing and laundry care may be in the form of gels. Gels may be sold as such or as part of a unit dose or as unit dose.

For pouches, various forms of marketing features have been developed. Particular features are containers with two or more compartments. The compartments may be filled with different ingredients of the unit dose. Such compartments may be separated from each other by a polymer film that is water-soluble under conditions of the application of the respective unit dose. It may be attractive to place such components into separate compartments that are incompatible otherwise, for example enzymes on one hand and bleaching agent(s) on the other hand, see, e. g., EP 2 217 690 B1.

An interesting feature for marketing purposes may be as well that different compartments may have different colors. However, it has turned out that in particular compartments that contain an aqueous solution of chelating agent suffer from color fading within a comparably short time, for example 2 weeks or less. Such fading is commercially inacceptable because the entire effect gets lost within the ordinary shelf life of such unit doses. In addition, the consumer may perceive the color fading to be linked to a drop in activity.

It is desired for advertising purposes, however, that at least a part of the chelating agent in multi-compartment containers are in a colorful formulation, for example a colorful solution or dispersion that maintains its color over more than 14 days. The fading of colors in the presence of MGDA has been disclosed in WO 2014/037746. The solution to this problem suggested is to have MGDA and the colorant in different phases. This solution, however, does not offer the fancy visual appearance.

It was therefore an objective of the present invention to provide colored aqueous formulations of at least one environmentally friendly chelating agent that maintain their color upon storage at ambient temperature for more than 14 days and that can be used as ingredient of care compositions such as fabric care compositions or hard surface cleaning compositions. It was further an objective to provide a method of making aqueous compositions that maintains their color over more than 14 days. It was further an objective to provide applications of colorful aqueous formulations.

Accordingly, the aqueous formulations defined at the outset have been found, hereinafter also defined as inventive formulations or as inventive aqueous formulations or as inventive (aqueous) formulations according to the present invention.

Inventive aqueous formulations contain water (D) as continuous phase. Water (D) serves as solvent of chelating agent (C). In some embodiments of the present invention, water is the sole solvent. In other embodiments, the solvent comprises water (D) and at least one water-soluble or water-miscible organic solvent, for example ethanol, isopropanol, ethylene glycol, 1,2-propylene glycol, diethylene glycol, triethylene glycol, N,N-diethanolamine, N,N-diisopropanolamine, and N-methyl N,N-diethanolamine. In other embodiments, said continuous phase does not contain any organic solvent.

Water (D) may be selected from salt-containing water and distilled water and demineralized water. Preferred is the use of demineralized water.

Inventive aqueous formulations contain (A) at least one pigment or at least one dyestuff, hereinafter also being referred to as pigment (A) or dyestuff (A), respectively. Pigment (A) is present in particulate form.

Pigments (A) for the purposes of the present invention are virtually insoluble, finely dispersed, organic or inorganic colorants as per the definition in German standard specification DIN 55944.

Preferred examples of organic pigments are selected from monoazo pigments, disazo pigments, anthranthrone pigments, anthraquinone pigments, anthrapyrimidine pigments, quinacridone pigments, quinophthalone pigments, dioxazine pigments, flavanthrone pigments, indanthrone pigments, isoindoline pigments, isoindolinone pigments, isoviolanthrone pigments, metal complex pigments, perinone pigments, perylene pigments, phthalocyanine pigments, pyranthrone pigments, thioindigo pigments, and triarylcarbonium pigments.

Illustrative examples of inorganic pigments are zinc oxide, zinc sulfide, lithopone, lead white, lead sulfate, chalk, titanium dioxide;

iron oxide yellow, cadmium yellow, nickel titanium yellow, chromium titanium yellow, chromium yellow, lead chromate, bismuth vanadate, Naples yellow or zinc yellow ultramarine blue, cobalt blue, manganese blue, iron blue, ultramarine green, cobalt green, chromium oxide (chromium oxide green);

ultramarine violet, cobalt violet, manganese violet;

ultramarine red, molybdate red, chromium red, cadmium red;

iron oxide brown, chromium iron brown, zinc iron brown, manganese titanium brown;

iron oxide black, iron-manganese black, spinel black, carbon black;

orange spinels and corandums, cadmium orange, chromium orange, lead molybdate;

aluminum or Cu/Zn alloy.

Preference is given to carbon black, iron oxide pigments such as for example iron oxide yellow, iron oxide brown and iron oxide black, zinc oxide and titanium oxide.

Pigments (A) are preferably selected from organic pigments or metal pigments.

Illustrative examples of organic pigments are monoazo pigments: C.I. Pigment Brown 25; C.I. Pigment Orange 5, 13, 36 and 67; C.I. Pigment Red 1, 2, 3, 5, 8, 9, 12, 17, 22, 23, 31, 48:1, 48:2, 48:3, 48:4, 49, 49:1, 52:1, 52:2, 53, 53:1, 53:3, 57:1, 63, 112, 146, 170, 184, 210, 245 and 251; C.I. Pigment Yellow 1, 3, 73, 74, 65, 97, 151 and 183;

disazo pigments: C.I. Pigment Orange 16, 34 and 44; C.I. Pigment Red 144, 166, 214 and 242;

C.I. Pigment Yellow 12, 13, 14, 16, 17, 81, 83, 106, 113, 126, 127, 155, 174, 176 and 188;

anthanthrone pigments: C.I. Pigment Red 168 (C.I. Vat Orange 3);

anthraquinone pigments: C.I. Pigment Yellow 147 and 177; C.I. Pigment Violet 31;

anthraquinone pigments: C.I. Pigment Yellow 147 and 177; C.I. Pigment Violet 31;

anthrapyrimidine pigments: C.I. Pigment Yellow 108 (CA. Vat Yellow 20);

quinacridone pigments: C.I. Pigment Red 122, 202 and 206; C.I. Pigment Violet 19;

quinophthalone pigments: C.I. Pigment Yellow 138;

dioxazine pigments: C.I. Pigment Violet 23 and 37;

flavanthrone pigments: C.I. Pigment Yellow 24 (C.I. Vat Yellow 1);

indanthrone pigments: C.I. Pigment Blue 60 (C.I. Vat Blue 4) and 64 (C.I. Vat Blue 6);

isoindoline pigments: C.I. Pigment Orange 69; C.I. Pigment Red 260; C.I. Pigment Yellow 139 and 185;

isoindolinone pigments: C.I. Pigment Orange 61; C.I. Pigment Red 257 and 260; C.I. Pigment Yellow 109, 110, 173 and 185;

isoviolanthrone pigments: C.I. Pigment Violet 31 (C.I. Vat Violet 1);

metal complex pigments: C.I. Pigment Yellow 117, 150 and 153; C.I. Pigment Green 8;

perinone pigments: C.I. Pigment Orange 43 (CA. Vat Orange 7); C.I. Pigment Red 194 (C.I. Vat Red 15);

perylene pigments: C.I. Pigment Black 31 and 32; C.I. Pigment Red 123, 149, 178, 179 (C.I. Vat Red 23), 190 (C.I. Vat Red 29) and 224; C.I. Pigment Violet 29;

phthalocyanine pigments: C.I. Pigment Blue 15, 15:1, 15:2, 15:3, 15:4, 15:6 and 16; C.I. Pigment Green 7 and 36;

pyranthrone pigments: C.I. Pigment Orange 51; C.I. Pigment Red 216 (C.I. Vat Orange 4);

thioindigo pigments: C.I. Pigment Red 88 and 181 (C.I. Vat Red 1); C.I. Pigment Violet 38 (C.I. Vat Violet 3);

triarylcarbonium pigments: C.I. Pigment Blue 1, 61 and 62; C.I. Pigment Green 1; C.I. Pigment Red 81, 81:1 and 169; C.I. Pigment Violet 1, 2, 3 and 27; C.I. Pigment Black 1 (aniline black);

C.I. Pigment Yellow 101 (aldazine yellow), C.I. Pigment Brown 22.

Examples of particularly preferred pigments are: C.I. Pigment Yellow 138, C.I. Pigment Red 122, C.I. Pigment Violet 19, C.I. Pigment Blue 15:1, 15:3 and 15:4, C.I. Pigment Black 7, C.I. Pigment Orange 5, 38 and 43 and C.I. Pigment Green 7.

Further suitable pigments (A) are metallic pigments such as for example gold bronze, silver bronze, Iriodin pigments, mica.

Examples of dyestuffs (A) are Acid Red 1, Acid Red 52, Acid Blue 9, Acid Yellow 3, Acid Yellow 23, Acid Yellow 73, Pigment Yellow 101, Acid Green 1, Solvent Green 7, and Acid Green 25.

The average diameter of pigments (A) is typically in the range from 20 nm to 1.5 μm and preferably in the range from 100 to 300 nm.

In one embodiment of the present invention, pigment (A) is present in spherical or substantially spherical particulate form, i.e., the ratio of the longest diameter to the smallest diameter is in the range from 1.0 to 2.0, preferably up to 1.5.

In inventive aqueous formulations, the concentration of pigment (A) or dyestuff (A) is in the range of from 5 to 500 ppm, preferably 50 to 250 ppm, referring to the total aqueous formulation.

Inventive aqueous formulations additionally contain at least one dispersant, hereinafter also being referred to as dispersant (B). Dispersant (B) is selected from (B1) copolymers of at least one ethylenically unsaturated $C_4$-$C_{10}$-dicarboxylic acid and at least one $C_4$-$C_{20}$-olefin, and their respective alkali metal salts, hereinafter altogether also being referred to as copolymers (B1) or dispersants (B1), and (B2) aromatic sulfonic acids and their respective alkali metal salts, hereinafter altogether also being referred to as sulfonic acids (B2) or dispersants (B2).

Copolymers (B1) are random copolymers or block copolymers or preferably alternating copolymers of at least one ethylenically unsaturated $C_4$-$C_{10}$-dicarboxylic acid, for example maleic acid, fumaric acid, itaconic acid, citraconic acid, metaconic acid, or maleic anhydride, preferred examples are maleic acid and maleic anhydride, and at least one $C_4$-$C_{20}$-olefin, preferably at least one $C_4$-$C_{20}$-α-olefin, for example linear $C_4$-$C_{20}$-α-olefins such as, for example 1-butene, 1-pentene, 1-hexene, 1-octene, 1-decene, 1-dodecene, 1-tetradecene, 1-hexadecene, 1-octadecene, 1-eicosene, or branched $C_4$-$C_{20}$-α-olefins such as iso-1-octene, iso-1-dodecene, diisobutene, and triisobutene. A preferred $C_4$-$C_{20}$-olefin is diisobutene. Copolymers (B1) may also be selected from the respective alkali metal salts of the above acids. The term alkali metal salts in the context of copolymers (B1) refers to partially or fully neutralized copolymers (B1), said neutralization having been performed with alkali such as potassium or preferably sodium or mixtures thereof.

Fully neutralized embodiments are preferred. The molar ratio of ethylenically unsaturated $C_4$-$C_{10}$-dicarboxylic acid and $C_4$-$C_{20}$-α-olefin is in the range of from 1:10 to 10:1, preferably 1:3 to 3:1, even more preferred 1:1.5 to 1.5:1. In case of alternating copolymers the preferred molar ratio is in the range of from 1:1.25 to 1.25:1.

Even more preferred examples of copolymers (B1) are random copolymers or block copolymers or preferably alternating copolymers of maleic anhydride and diisobutene and their respective alkali metal salts.

In one embodiment of the present invention, copolymers (B1) are selected from those that have a K-value according to Fikentscher in the range of from 25 and 45, determined according to ISO 1628-1 in a 1 wt-% solution in water at pH of 7.

Sulfonic acids (B2) may be selected from benzene sulfonic acid, α-naphthalenesulfonic acid, β-naphthalene sulfonic acid, naphthalenedisulfonic acids, especially naphthalene-1, 5-disulfonic acid and naphthalene-2,7-disulfonic acid, ortho- and para-toluenesulfonic acid, ortho- and para-$C_2$-$C_{20}$-alkylbenzene sulfonic acid and mixtures of at least two of the foregoing, and in particular polymeric sulfonic acids such as lignine sulfonates and polymeric condensation products of at least one aliphatic aldehyde such as acetaldehyde or particularly formaldehyde and at least one aromatic sulfonic acid such as benzene sulfonic acid, α-naphthalenesulfonic acid, β-naphthalenesulfonic acid, ortho- and para-toluenesulfonic acid, ortho- and para-$C_2$-$C_{20}$-alkylbenzene sulfonic acid and mixtures of at least two of the foregoing.

In one embodiment of the present invention, sulfonic acids (B2) are selected from those whose sodium salts (fully neutralized) have an average molecular weight $M_w$ in the range of from 500 to 30,000 g/mol, preferred are 4,500 to 6,000 g/mole, determined by GPC, using a mixture of 60% by weight of 0.1 mol/l aqueous $NaNO_3$ solution, 30% by weight of tetrahydrofurane (THF) and 10% by weight of acetonitrile as mobile phase and cross-linked hydroxyethylmethacrylate as stationary phase.

In one embodiment of the present invention, polycondensates of at least one aliphatic aldehyde and at least one aromatic sulfonic acid are made using aliphatic aldehyde(s) and aromatic sulfonic acid(s) in a total molar ratio in the range of from 1.5:1 to 1:1.5, preferably 1.5:1 to 1:1.1.

Sulfonic acid (B2) may be applied as free acid or preferably in partially or fully neutralized form, said neutralization having been performed with alkali such as potassium or preferably sodium or mixtures thereof. Full neutralization is even more preferred.

In a preferred embodiment of the present invention, sulfonic acids (B2) are selected from alkali metal salts of naphthalene sulfonic acids that may have been reacted with formaldehyde . Said reaction is usually a condensation reaction or polycondensation reaction.

The weight ratio of dispersing agent (B) to pigment (A) or to dyestuff (A), respectively, is in the range of from 3:1 to 1:5, preferably 2.5:1 to 1:2 and even more preferably 1.6:1 to 1:1.1.

Inventive aqueous formulations further contain at least one chelating agent (C), hereinafter in brief also being referred to as chelating agent (C). Chelating agent (C) is selected from methyl glycine diacetic acid, also being referred to as MGDA, and glutamic acid diacetic acid, also being referred to as GLDA, and from iminodisuccinic acid, also referred to as IDS, and citric acid, and their respective ammonium and alkali metal salts, alkali metal salts being preferred.

In the context of the present invention, alkali metal salts of MGDA are selected from lithium salts, potassium salts and preferably sodium salts of MGDA. MGDA can be partially or preferably fully neutralized with the respective alkali. In a preferred embodiment, an average of from 2.7 to 3 COOH groups of MGDA is neutralized with alkali metal, preferably with sodium. In a particularly preferred embodiment, chelating agent (C) is the trisodium salt of MGDA.

Likewise, alkali metal salts of GLDA are selected from lithium salts, potassium salts and preferably sodium salts of glutamic acid diacetic acid. GLDA can be partially or preferably fully neutralized with the respective alkali. In a preferred embodiment, an average of from 3.5 to 4 COOH groups of GLDA is neutralized with alkali metal, preferably with sodium. In a particularly preferred embodiment, chelating agent (C) is the tetrasodium salt of GLDA.

Likewise, alkali metal salts of IDS are selected from lithium salts, potassium salts and preferably sodium salts of iminodisuccinic acid. ISD can be partially or preferably fully neutralized with the respective alkali. In a preferred embodiment, an average of from 3.5 to 4 COOH groups of IDS is neutralized with alkali metal, preferably with sodium. In a particularly preferred embodiment, chelating agent (C) is the tetrasodium salt of IDS.

In the context of the present invention, alkali metal salts of citric acid are selected from lithium salts, potassium salts and preferably sodium salts of citric acid. Citric acid can be partially or preferably fully neutralized with the respective alkali. In a preferred embodiment, an average of from 2.7 to 3 COOH groups of citric acid is neutralized with alkali metal, preferably with sodium. In a particularly preferred embodiment, chelating agent (C) is the trisodium salt of citric acid.

Preferably, chelating agent (C) is selected from the MGDA and GLDA and their respective alkali metal salts.

In one embodiment of the present invention, chelating agent (C) is selected from mixtures of L- and D-enantiomers of molecules of general formula (I)

$$[CH_3—CH(COO)—N(CH_2—COO)_2]M_{3-x}H_x \quad (I)$$

wherein x is in the range of from zero to 0.5, preferably from zero to 0.25,

M is selected from ammonium, substituted or non-substituted, and potassium and sodium and mixtures thereof, preferably sodium. Examples of $M_{3-x}H_x$ are $Na_{3-x}H_x$, $[Na_{0.7}(NH_4)_{0.3}]_{3-x}H_x$, $[(NH_4)_{0.7}Na_{0.3}]_{3-x}H_x$, $(K_{0.7}Na_{0.3})_{3-x}H_x$, $(Na_{0.7}K_{0.3})_{3-x}H_x$, $(K_{0.22}Na_{0.78})_{3-x}H_x$, $(Na_{0.22}K_{0.78})_{3-x}H_x$, and $K_{3-x}H_x$. Preferred examples of $M_{3-x}H_x$ are selected from $Na_3$, $Na_2K$, $K_2Na$, $Na_{2.65}K_{0.35}$, $K_{2.65}Na_{0.35}$, $K_3$, $(K_{0.85}Na_{0.15})_{3-x}H_x$, and $(Na_{0.85}K_{0.15})_{3-x}H_x$.

Preferred are the trialkali metal salts of MGDA such as the tripotassium salts, the disodium monopotassium salt of MGDA, the dipotassium monosodium salt of MGDA, of trialkali metal salts wherein 20 to 25 mole-% of the alkali are potassium and the remaining 75 to 80 mole-% are sodium, of trialkali metal salts wherein 20 to 25 mole-% of the alkali metal are sodium and the remaining 75 to 80 mole-% mole-% are potassium, and of the tripotassium salt of MGDA.

In one embodiment of the present invention, the enantiomeric excess of the respective L-isomer in chelating agent (C) is in the range of from 5 to 85%, preferably in the range of from 10 to 75% and even more preferably from 20 to 60%.

In embodiments where two or more compounds of general formula (I) are present, the ee refers to the enantiomeric excess of all L-isomers present in the respective mixture compared to all D-isomers. For example, in cases wherein a mixture of the di- and trisodium salt of MGDA is present, the ee refers to the sum of the disodium salt and trisodium salt of L-MGDA with respect to the sum of the disodium salt and the trisodium salt of D-MGDA.

The enantiomeric excess can be determined by measuring the polarization (polarimetry) or preferably by chromatography, for example by HPLC with a chiral column, for example with one or more cyclodextrins as immobilized phase or with a ligand exchange (Pirkle-brush) concept chiral stationary phase. Preferred is a determination of the ee by HPLC with an immobilized optically active amine such as D-penicillamine in the presence of copper(II) salt.

In one embodiment of the present invention, MGDA may contain in the range of from 0.1 to 10% by weight of one or more optically inactive impurities, at least one of the impurities being selected from iminodiacetic acid, formic acid, glycolic acid, propionic acid, acetic acid and their respective alkali metal or mono-, di- or triammonium salts. In one embodiment of the present invention, inventive mixtures may contain less than 0.2% by weight of nitrilotriacetic acid (NTA), preferably 0.01 to 0.1% by weight. The percentages refer to total chelating agent (C).

In one embodiment of the present invention, MGDA may contain in the range of from 0.1 to 10% by weight of one or more optically active impurities, at least one of the impurities being selected from L-carboxymethylalanine and its respective mono- or dialkali metal salts, and optically active mono- or diamides that result from an incomplete saponification during the synthesis of MGDA. Preferably, the amount of optically active impurities is in the range of from 0.01 to 1.5% by weight, referring to MGDA. Even more preferably, the amount of optically active impurities is in the range of from 0.1 to 0.2% by weight.

In one embodiment of the present invention, chelating agent (C) are selected from mixtures of L- and D-enantiomers of molecules of general formula (II)

$$[OOC—(CH_2)_2—CH(COO)—N(CH_2—COO)_2]M_{4-x}H_x \quad (II)$$

wherein x and M are defined as above.

Examples of $M_{4-x}H_x$ are $Na_{4-x}H_x$, $Na_4$, $Na_3K$, $K_3Na$, $[Na_{0.7}(NH_4)_{0.3}]_{4-x}H_x$, $[(NH_4)_{0.7}Na_{0.3}]_{4-x}H_x$, $(K_{0.7}Na_{0.3})_{4-x}H_x$, $(Na_{0.7}K_{0.3})_{4-x}H_x$, $(K_{0.22}Na_{0.78})_{4-x}H_x$, $(Na_{0.22}K_{0.78})_{4-x}H_x$, and $Ka_{4-x}H_x$. Preferred examples of $M_{4-x}H_x$ are selected from $Na_4$, $Na_3K$, $K_3Na$, $Na_{0.65}K_{3.25}$, $K_{0.65}Na_{3.35}$, $K_4$, $(K_{0.85}Na_{0.15})_{4-x}H_x$, and $(Na_{0.85}K_{0.15})_{4-x}H_x$.

Preferred examples of compounds according to general formula (II) are the tetraalkali metal salts of GLDA such as the tetrapotassium salts, the disodium dipotassium salt of GLDA, of the tripotassium monosodium salt of GLDA, of tetraalkali metal salts wherein 20 to 25 mole-% of the alkali are potassium and the remaining 75 to 80 mole-% are sodium, of tetraalkali metal salts wherein 20 to 25 mole-% of the alkali metal are sodium and the remaining 75 to 80 mole-% mole-% are potassium, and of the tetrapotassium salt of GLDA.

In one embodiment of the present invention, the enantiomeric excess of the respective L-isomer in chelating agent (C) selected from compounds according to general formula (II) is in the range of from 5 to 85%, preferably in the range of from 10 to 85% and even more preferably at least 20%.

In embodiments where two or more compounds of general formula (II) are present, the ee refers to the enantiomeric excess of all L-isomers present in the respective mixture compared to all D-isomers. For example, in cases wherein a mixture of the tri- and tetrasodium salt of GLDA is present, the ee refers to the sum of the trisodium salt and tetrasodium salt of L-GLDA with respect to the sum of the trisodium salt and the tetrasodium salt of D-GLDA.

The enantiomeric excess of compounds according to general formula (II) may be determined by measuring the polarization (polarimetry) or by chromatography, for example by HPLC with a chiral column or by chiral capillary electrophoresis.

In one embodiment of the present invention, chelating agent (C) selected from compounds according to general formula (II) may contain in the range of from 0.1 to 10% by weight of one or more optically inactive impurities, at least one of the impurities being selected from iminodiacetic acid, formic acid, glycolic acid, propionic acid, acetic acid and their respective alkali metal or mono-, di- or triammonium salts. In one embodiment of the present invention, inventive mixtures may contain less than 0.2% by weight of nitrilotriacetic acid (NTA), preferably 0.01 to 0.1% by weight. The percentages refer to total chelating agent (C).

In one embodiment of the present invention, chelating agent (C) selected from compounds according to general formula (II) may contain in the range of from 0.1 to 10% by weight of one or more optically active impurities, at least one of the impurities being selected from L-carboxymethylglutamate and its respective mono- or dialkali metal salts and the respective lactam, and optically active mono- or diamides that result from an incomplete saponification during the synthesis of chelating agent (C). Preferably, the amount of optically active impurities is in the range of from 0.01 to 1.5% by weight, referring to chelating agent (C). Even more preferably, the amount of optically active impurities is in the range of from 0.1 to 0.2% by weight.

In one aspect of the present invention, chelating agent (C) may contain minor amounts of cations other than alkali metal or ammonium. It is thus possible that minor amounts, such as 0.01 to 5 mol-% of total chelating agent, based on anion, bear alkali earth metal cations such as $Mg^{2+}$ or $Ca^{2+}$, or transition metal ions such as $Fe^{2+}$ or $Fe^{3+}$ cations.

In one embodiment of the present invention, the inventive aqueous formulation contains in the range of from 10 to 60% by weight of chelating agent (C), preferably 20 to 55% by weight, more preferably 35 to 50% by weight and even more preferably 44 to 50% by weight.

In one embodiment of the present invention, inventive aqueous formulation may have a total solids content in the range of from 10 to 60%.

In one embodiment of the present of the present invention, inventive aqueous formulations have a pH value in the range of from 8 to 14, preferably 10 to 12, determined at a 1 wt % aqueous formulation referring to the total solids content.

In one embodiment of the present invention, inventive aqueous formulations are free from enzyme. In the context of the present invention, the term "free from enzyme" applies to aqueous formulations that contain less than 10 ppm of enzyme or even no detectable amounts.

Preferably, inventive aqueous formulations are free from bleaching agents such as hydrogen peroxide and sodium percarbonate. In the context of the present invention, the term "free from bleaching agents" applies to aqueous formulations that contain less than 100 ppm of bleaching agent or even no detectable amounts.

In a preferred embodiment of the present invention, inventive aqueous solutions contain neither peroxide nor enzyme. Such preferred embodiments usually exhibit a longer shelf-life.

In one embodiment of the present invention, inventive aqueous formulations may contain at least one viscosity modifying agent, for example a thickener, also being termed as thickening agent. Examples of thickeners are natural and synthetic thickeners. Examples of thickeners are agar-agar, carragene, tragacanth, gum arabic, alginates, pectins, hydroxyethyl cellulose, hydroxypropyl cellulose, starch, gelatin, locust bean gum, cross-linked poly(meth)acrylates, for example polyacrylic acid cross-linked with methylene bis-(meth)acrylamide, furthermore silicic acid, clay such as—but not limited to—montmorillonite, zeolite, and furthermore dextrin and casein.

In one embodiment of the present invention, inventive aqueous formulations may contain at least one inorganic salt. Examples of such inorganic salts are NaOH, KOH, $Na_2SO_4$, $K_2SO_4$, KCl and NaCl. Especially dispersant (B2) usually contains $Na_2SO_4$ or $K_2SO_4$, as impurities stemming from their syntheses. In a special embodiment, inventive aqueous formulations contain 0.001 to 1% by weight of inorganic salt.

In one embodiment of the present invention, inventive aqueous formulation may contain at least one chelating agent other than MGDA or GLDA. Examples are citric acid and its respective alkali metal salts and aminopolycarboxylates and their respective alkali metal salts such as IDS and IDS-$Na_4$, and phosphonic acid derivatives, for example the disodium salt of hydroxyethane-1,1-diphosphonic acid ("HEDP"). In other embodiments, the inventive aqueous formulation does not contain any chelating agent other than MGDA or GLDA.

In one embodiment of the present invention, inventive aqueous formulations have a dynamic viscosity in the range of from 100 to 30,000 mPa·s, determined in accordance with DIN 53018-1:2008-09 at 25° C. In preferred embodiments that are gels, the dynamic viscosity of such aqueous formulations is in the range of from 400 to 2,000 mPa·s, preferably 450 1,800 mPa·s if such gels are determined for use in laundry care applications. In other preferred embodiments that are gels, the dynamic viscosity is in the range of from 1,000 to 25,000 mPa·s, even more preferably from 2,500 to 20,000 mPa·s if such gels are determined for use in automatic dishwashing applications.

Inventive aqueous formulations exhibit an overall usefulness in single unit doses, for example for laundry cleaning and especially for automatic dishwashing. They do not only provide an environmentally friendly chelating agent in an efficient way. They also show great color stability even after several weeks.

Another aspect of the present invention is related to transparent or translucent containers containing an aqueous formulation according to the present invention. In the context of the present invention, such containers are also being referred to as inventive containers or as containers according to the present invention or as containers filled according to the present invention. In the context of the present invention, transparent containers are defined to let visible light pass through, the photons macroscopically following Snell's law subject to diffraction. In the context of the present invention, translucent containers are defined to let a certain percentage of the visible light pass through—and macroscopically following Snell's law—and only a minor part being scattered.

Inventive containers may comprise one or more compartments, of which at least one contains inventive aqueous formulations. In inventive containers comprising two or more compartments, at least one but preferably not all compartments contain inventive formulation. Even more preferably, in inventive containers comprising two or more compartments, one compartment contains inventive formulation and the other(s) do not.

In a preferred embodiment of the present invention, said inventive container is a di-, tri- or multi-compartment container of which one compartment contains an inventive aqueous formulation and the other compartment(s) do not.

In an even more preferred embodiment of the present invention, said inventive container is a di-, tri- or multi-compartment pouch of which one compartment contains an inventive aqueous formulation and the other compartment(s) does not or do not, respectively.

In one embodiment of the present invention inventive containers are in the form of a box with one or more compartments or in the form of a sachet with one or more compartments or in the form of a pouch with one or more compartments or in the form of a combination of a box and one or more pouches, especially in the form of the combination of a box and one pouch. In such a combination of a box and a pouch may be connected to each other, e.g., by gluing them together. A pouch with two compartments may also be referred to as two-chamber pouch. A pouch with a single compartment may also be referred to as one-chamber pouch. Thus, in particular embodiments, containers according to the present invention may be in the form of a two-chamber pouch or in the form of a combination of a box and a one-chamber pouch.

Inventive containers may be mechanically flexible or stiff. The distinction between mechanically flexible and mechanically stiff may be made by manual determination of the degree of deformability by an average end user with two fingers. If such an average end user can deform the shape of said container by at least 5% into one dimension the respective container is deemed mechanically flexible, otherwise it is deemed stiff.

In specific embodiments, inventive containers are tablets that have at least one cavity per tablet. Per cavity there is at least one pouch, preferably there is at least one pouch placed into the cavity and attached to the tablet. In special embodiment, the volume of the pouch including the inventive aqueous formulation corresponds to the volume of the cavity, for example they may have the same volume ±10%, preferably ±5%. The better shape and size of cavity and the pouch including inventive aqueous formulation correspond to each other the less breakage during transport can be observed. Such tablets may be packaged in a film of, e.g., polyvinyl alcohol. The tablet comprises components of the respective detergent composition such as surfactants, builder(s), enzymes, and/or bleaching agent.

In another specific embodiment, inventive containers are a box that has at least one cavity per box. Per cavity there is at least one pouch, preferably there is at least one pouch placed into the cavity and attached to the box. In special embodiment, the volume of the pouch including the inventive aqueous formulation corresponds to the volume of the cavity, for example they may have the same volume ±10%, preferably ±5%. The better shape and size of cavity and the pouch including the inventive aqueous formulation correspond to each other the less breakage during transport can be observed. The box comprises components of the respective detergent composition such as surfactants, builder(s), enzymes, and/or bleaching agent.

In another specific embodiment, inventive containers are pouches that encompass at least two compartments, for example two, three or four compartments. One of the compartments contains the inventive aqueous formulation. The other components of the respective detergent compositions are in the one or more other compartment(s).

In one embodiment of the present invention, all chelating agent (C) that is comprised in inventive containers is in the very compartment in dissolved form. In another embodiment of the present invention, a share of chelating agent (C) is comprised in one compartment in dissolved form, as stated above, and more chelating agent (C) is comprised in the other compartment or one other compartment, as applicable, of the inventive container.

In one embodiment of the present invention, containers according to the present invention and especially pouches have a diameter in the range of from 0.5 to 7 cm.

In one embodiment of the present invention, containers according to the present invention and especially pouches have a volume—in the closed state—in the range of from 15 to 70 ml, preferably 18 ml to 50 ml and in particular 20 to 30 ml. Such inventive containers are particularly useful for automatic dishwash in home care application. Inventive containers particularly useful for fabric care in home care applications may have a volume in the range of from 15 to 40 ml, preferably 25 to 30 ml.

In one embodiment of the present invention, each compartment has a volume in the range of from 0.5 to 50 ml, preferably 5 to 25 ml. In embodiments wherein inventive containers encompass two or more compartments, such compartments may have equal size or different size. Preferably, in embodiments wherein inventive containers encompass two or more compartments, such containers encompass one major compartment and one or two or three smaller compartments.

Inventive containers are preferably made from polymer, preferably from a water-soluble polymer. Pouches in the context of the present invention are made from a polymer film.

Said polymer may be selected from natural polymers, modified natural polymers, and synthetic polymers. Examples of suitable natural polymers are alginates, especially sodium alginate, furthermore xanthum, carragum, dextrin, maltodextrin, gelatine, starch, and pectin. Examples of suitable modified natural polymers are methylcellulose, ethylcellulose, carboxymethyl cellulose, hydroxypropylcellulose, hydroxypropyl methyl cellulose (HPMC), and hydroxymethyl cellulose. Examples of suitable synthetic polymers are polyvinyl pyrrolidone, polyacrylamide, polyalkylene glycols, preferably polypropylene glycol and polyethylene glycol, especially polyethylene glycol with a molecular weight $M_w$ in the range of at least 2,000 g/mol, preferably of from 3,000 to 100,000 g/mol, and in particular polyvinyl alcohol.

The term "polyvinyl alcohol" as used herein does not only include homopolymers of polyvinyl alcohol that can be made by free-radical polymerization of vinyl acetate followed by subsequent hydrolysis (saponification) of all or the vast majority of the ester groups. Polyvinyl alcohol also includes copolymers obtainable by free-radical copolymerization of vinyl acetate and at least one comonomer selected from maleic acid, maleic anhydride, itaconic anhydride, methyl (meth)acrylate and 2-acrylamido-2-methyl propanesulfonic acid ("AMPS").

In a preferred embodiment of the present invention, polyvinyl alcohol as used for making containers and especially pouches has an average degree of polymerization (weight average) in the range of from 500 to 3,000 g/mol. The molecular weight $M_w$ of such polyvinyl alcohol is preferably, in the range of from 6,000 to 250,000 g/mol, preferably up to 75,000 g/mol. The molecular weight is preferably determined by gel permeation chromatography of the respective polyvinyl acetate or respective copolymer before saponification.

Preferably, polyvinyl alcohol used for making inventive containers and especially pouches is atactic as determined by $^1$H NMR spectroscopy.

Polyvinyl alcohols used for making containers—especially pouches—essentially have repeating units of ($CH_2$—CHOH). The hydroxyl groups in polyvinyl alcohol are mostly in 1,3-position, thus forming structural units of the type —$CH_2$—CH(OH)—$CH_2$—CH(OH)—. In minor amounts (1 to 2 mole-%) there are germinal hydroxyl groups, thus forming structural units of —$CH_2$—CH(OH)—CH(OH)—$CH_2$—.

One or more modified polyvinyl alcohols may be employed as polymers instead of polyvinyl alcohol or in combination with polyethylene glycol or with polyvinyl alcohol. Examples are graft copolymers such as polyalkylene glycol grafted with polyvinyl acetate followed by subsequent hydrolysis/saponification of the ester groups.

Polymer may be used without or with one or more additives. Suitable additives are especially plasticizers such as $C_4$-$C_{10}$-dicarboxylic acids, for example adipic acid, and glycols such as ethylene glycol and diethylene glycol.

Due to their production, commercially available polyvinyl alcohols usually have residual non-saponified ester groups, especially acetate groups. Polyvinyl alcohols used for making containers and especially pouches for embodiments of the present invention essentially have a degree of saponification in the range of from 87 to 89 mole-%. The degree of saponification can be determined in accordance with the determination of the ester value, for example according to DIN EN ISO 3681 (2007-10).

In one embodiment of the present invention, polyvinyl alcohols used for making containers and especially for making pouches for embodiments of the present invention have a glass transition temperature in the range of from 55 to 60° C., preferably 58° C., determinable according to, e.g., DIN 53765: 1994-03, or ISO 11357-2: 1999-03.

In one embodiment of the present invention, polyvinyl alcohols used for making inventive containers and especially for making pouches for embodiments of the present invention have a melting point in the range of from 185 to 187° C.

In one embodiment of the present invention, polyvinyl alcohols used for making for embodiments of the present invention and especially for making pouches comprising a single unit dose are partially acetalized or ketalized with sugars such as, glucose, fructose, or with starch. In another embodiment of the present invention polyvinyl alcohols used for making containers and especially pouches are partially esterified with, e. g., maleic acid or itaconic acid.

In one embodiment of the present invention, polyvinyl alcohol films may contain a plasticizer. Plasticizers may be used for reducing the stiffness of such polyvinyl alcohol films. Suitable compounds usable as plasticizers for polyvinyl alcohol are ethylene glycol, diethylene glycol, triethylene glycol, polyethylene glycol, for example with an average molecular weight $M_w$ up to 400 g/mol, glycerol, trimethylol propane, triethanolamine, and neo-pentyl glycol. Up to 25% by weight of the respective polyvinyl alcohol may be plasticizer.

In one embodiment of the present invention, said pouches are being made from a polymer film, said polymer being water-soluble at a temperature of at least 40° C., for example in the range of from 40 to 95° C., but insoluble in water at a temperature in the range of from 5 to 30° C. In other embodiments, said pouches are being made from polymer films that are soluble in water even at 1° C. In the context of the present invention, the terms water-soluble and soluble in water are used interchangeably. They both refer to polymers that dissolve in water at 20° C., methods of determination being discussed below. However, such polymers dissolve much slower or not detectably at all in the aqueous medium containing chelating agent (C). A polymer is deemed water-soluble if the percentage of solubility is at least 90%. A suitable method of determination of the percentage is being disclosed below.

Examples of polymer films that are soluble at 1° C. or more and of polymer films that are soluble at 40° C. are polyvinyl alcohol films available from Syntana E. Harke GmbH & Co under the trademark of Solublon®.

In one embodiment of the present invention, polymer films and preferably polyvinyl alcohol films used for making pouches that can be used in the present invention have a thickness (strength) in the range of from 10 to 100 μm, preferably 20 to 90 μm, even more preferably 25 to 35 μm. If the strength of polymer films and especially of polyvinyl alcohol films exceeds 100 μm it takes too long to dissolve them during the washing cycle. If the strength of polymer films and especially of polyvinyl alcohol films is below 10 μm they are too sensitive to mechanical stress.

Inventive containers may comprise one or more further substance useful in detergent compositions, especially in detergent compositions useful in laundry care or automatic dishwashing. Examples of such substances are surfactants, especially anionic surfactants and non-ionic surfactants.

Preferred non-ionic surfactants are alkoxylated alcohols, di- and multiblock copolymers of ethylene oxide and propylene oxide and reaction products of sorbitan with ethylene oxide or propylene oxide, alkyl polyglycosides (APG), hydroxyalkyl mixed ethers and amine oxides.

Preferred examples of alkoxylated alcohols and alkoxylated fatty alcohols are, for example, compounds of the general formula (III)

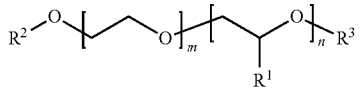

(III)

in which the variables are defined as follows:

$R^1$ is identical or different and selected from hydrogen and linear $C_1$-$C_{10}$-alkyl, preferably in each case identical and ethyl and particularly preferably hydrogen or methyl, $R^2$ is selected from $C_8$-$C_{22}$-alkyl, branched or linear, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^3$ is selected from $C_1$-$C_{10}$-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl.

The variables m and n are in the range from zero to 300, where the sum of n and m is at least one, preferably in the range of from 3 to 50. Preferably, m is in the range from 1 to 100 and n is in the range from 0 to 30.

In one embodiment, compounds of the general formula (III) may be block copolymers or random copolymers, preference being given to block copolymers.

Other preferred examples of alkoxylated alcohols are, for example, compounds of the general formula (IV)

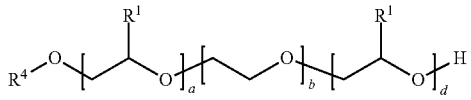

(IV)

in which the variables are defined as follows:

$R^1$ is identical or different and selected from hydrogen and linear $C_1$-$C_0$-alkyl, preferably identical in each case and ethyl and particularly preferably hydrogen or methyl, $R^4$ is selected from $C_6$-$C_{20}$-alkyl, branched or linear, in particular n-$C_8H_{17}$, n-$C_{10}H_{21}$, n-$C_{12}H_{25}$, n-$C_{13}H_{27}$, n-$C_{15}H_{31}$, n-$C_{14}H_{29}$, n-$C_{16}H_{33}$, n-$C_{18}H_{37}$, a is a number in the range from zero to 10, preferably from 1 to 6, b is a number in the range from 1 to 80, preferably from 4 to 20, d is a number in the range from zero to 50, preferably 4 to 25.

The sum a+b+d is preferably in the range of from 5 to 100, even more preferably in the range of from 9 to 50.

Preferred examples for hydroxyalkyl mixed ethers are compounds of the general formula (V)

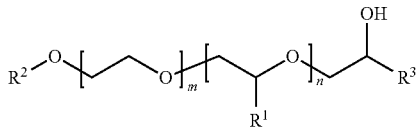

(V)

in which the variables are defined as follows:

$R^1$ is identical or different and selected from hydrogen and linear $C_1$-$C_{10}$-alkyl, preferably in each case identical and ethyl and particularly preferably hydrogen or methyl, $R^2$ is selected from $C_8$-$C_{22}$-alkyl, branched or linear, for example iso-$C_{11}H_{23}$, iso-$C_{13}H_{27}$, n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^3$ is selected from $C_1$-$C_{18}$-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl, isodecyl, n-dodecyl, n-tetradecyl, n-hexadecyl, and n-octadecyl.

The variables m and n are in the range from zero to 300, where the sum of n and m is at least one, preferably in the range of from 5 to 50. Preferably, m is in the range from 1 to 100 and n is in the range from 0 to 30.

Compounds of the general formula (IV) and (V) may be block copolymers or random copolymers, preference being given to block copolymers.

Further suitable nonionic surfactants are selected from di- and multiblock copolymers, composed of ethylene oxide and propylene oxide. Further suitable nonionic surfactants are selected from ethoxylated or propoxylated sorbitan esters. Amine oxides or alkyl polyglycosides, especially linear $C_4$-$C_{16}$-alkyl polyglucosides and branched $C_8$-$C_{14}$-alkyl polyglycosides such as compounds of general average formula (VI) are likewise suitable.

(VI)

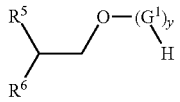

wherein:

$R^5$ is $C_1$-$C_4$-alkyl, in particular ethyl, n-propyl or isopropyl, $R^6$ is $—(CH_2)_2—R^5$, $G^1$ is selected from monosaccharides with 4 to 6 carbon atoms, especially from glucose and xylose, y in the range of from 1.1 to 4, y being an average number.

Further examples of non-ionic surfactants are compounds of general formula (VII) and (VIII)

(VII)

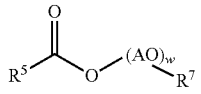

(VIII)

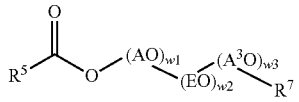

AO is selected from ethylene oxide, propylene oxide and butylene oxide,

EO is ethylene oxide, $CH_2CH_2$—O, $R^7$ selected from $C_8$-$C_{18}$-alkyl, branched or linear $A^3O$ is selected from propylene oxide and butylene oxide, w is a number in the range of from 15 to 70, preferably 30 to 50, w1 and w3 are numbers in the range of from 1 to 5, and w2 is a number in the range of from 13 to 35.

An overview of suitable further nonionic surfactants can be found in EP-A 0 851 023 and in DE-A 198 19 187.

Mixtures of two or more different nonionic surfactants may also be present.

Other surfactants that may be present are selected from amphoteric (zwitterionic) surfactants and anionic surfactants and mixtures thereof.

Examples of amphoteric surfactants are those that bear a positive and a negative charge in the same molecule under use conditions. Preferred examples of amphoteric surfactants are so-called betaine-surfactants. Many examples of betaine-surfactants bear one quaternized nitrogen atom and one carboxylic acid group per molecule. A particularly preferred example of amphoteric surfactants is cocamidopropyl betaine (lauramidopropyl betaine).

Examples of amine oxide surfactants are compounds of the general formula (IX)

$$R^8R^9R^{10}N\rightarrow O \quad (IX)$$

wherein $R^8$, $R^9$ and $R^{10}$ are selected independently from each other from aliphatic, cycloaliphatic or $C_2$-$C_4$-alkylene $C_{10}$-$C_{20}$-alkylamido moieties. Preferably, $R^{10}$ is selected from $C_8$-$C_{20}$-alkyl or $C_2$-$C_4$-alkylene $C_{10}$-$C_{20}$-alkylamido and $R^8$ and $R^9$ are both methyl.

A particularly preferred example is lauryl dimethyl aminoxide, sometimes also called lauramine oxide. A further particularly preferred example is cocamidylpropyl dimethylaminoxide, sometimes also called cocamidopropylamine oxide.

Examples of suitable anionic surfactants are alkali metal and ammonium salts of $C_8$-$C_{18}$-alkyl sulfates, of $C_8$-$C_{18}$-fatty alcohol polyether sulfates, of sulfuric acid half-esters of ethoxylated $C_4$-$C_{12}$-alkylphenols (ethoxylation: 1 to 50 mol of ethylene oxide/mol), $C_{12}$-$C_{18}$ sulfo fatty acid alkyl esters, for example of $C_{12}$-$C_{18}$ sulfo fatty acid methyl esters, furthermore of $C_{12}$-$C_{18}$-alkylsulfonic acids and of $C_{10}$-$C_{18}$-alkylarylsulfonic acids. Preference is given to the alkali metal salts of the aforementioned compounds, particularly preferably the sodium salts.

Further examples for suitable anionic surfactants are soaps, for example the sodium or potassium salts of stearoic acid, oleic acid, palmitic acid, ether carboxylates, and alkylether phosphates.

In one embodiment of the present invention, detergent compositions comprised in inventive containers may contain 0.1 to 60% by weight of at least one surfactant, selected from anionic surfactants, amphoteric surfactants and amine oxide surfactants.

In a preferred embodiment, detergent compositions comprised in inventive containers do not contain any anionic surfactant.

Detergent compositions comprised in inventive containers may contain at least one bleaching agent, also referred to as bleach. Bleaching agents may be selected from chlorine bleach and peroxide bleach, and peroxide bleach may be selected from inorganic peroxide bleach and organic peroxide bleach. Preferred are inorganic peroxide bleaches, selected from alkali metal percarbonate, alkali metal perborate and alkali metal persulfate.

Examples of organic peroxide bleaches are organic percarboxylic acids, especially organic percarboxylic acids.

Suitable chlorine-containing bleaches are, for example, 1,3-dichloro-5,5-dimethylhydantoin, N-chlorosulfamide, chloramine T, chloramine B, sodium hypochlorite, calcium hypochlorite, magnesium hypochlorite, potassium hypochlorite, potassium dichloroisocyanurate and sodium dichloroisocyanurate.

Detergent compositions comprised in inventive containers compositions may comprise, for example, in the range from 3 to 10% by weight of chlorine-containing bleach.

Detergent compositions comprised in inventive containers may comprise one or more bleach catalysts. Bleach catalysts can be selected from bleach-boosting transition metal salts or transition metal complexes such as, for example, manganese-, iron-, cobalt-, ruthenium- or molybdenum-salen complexes or carbonyl complexes. Manganese, iron, cobalt, ruthenium, molybdenum, titanium, vanadium and copper complexes with nitrogen-containing tripod ligands and also cobalt-, iron-, copper- and ruthenium-amine complexes can also be used as bleach catalysts.

Detergent compositions comprised in inventive containers may comprise one or more bleach activators, for example N-methylmorpholinium-acetonitrile salts ("MMA salts"), trimethylammonium acetonitrile salts, N-acylimides such as, for example, N-nonanoylsuccinimide, 1,5-diacetyl-2,2-dioxohexahydro-1,3,5-triazine ("DADHT") or nitrile quats (trimethylammonium acetonitrile salts).

Further examples of suitable bleach activators are tetraacetylethylenediamine (TAED) and tetraacetylhexylenediamine.

Detergent compositions comprised in inventive containers may comprise one or more corrosion inhibitors. In the present case, this is to be understood as including those compounds which inhibit the corrosion of metal. Examples of suitable corrosion inhibitors are triazoles, in particular benzotriazoles, bisbenzotriazoles, aminotriazoles, alkylaminotriazoles, also phenol derivatives such as, for example, hydroquinone, pyrocatechol, hydroxyhydroquinone, gallic acid, phloroglucinol or pyrogallol.

In one embodiment of the present invention, detergent compositions comprised in inventive containers comprise in total in the range from 0.1 to 1.5% by weight of corrosion inhibitor.

Detergent compositions comprised in inventive containers may comprise one or more builders, selected from organic and inorganic builders. Examples of suitable inorganic builders are sodium sulfate or sodium carbonate or silicates, in particular sodium disilicate and sodium metasilicate, zeolites, sheet silicates, in particular those of the formula $\alpha$-$Na_2Si_2O_5$, $\beta$-$Na_2Si_2O_5$, and $\delta$-$Na_2Si_2O_5$, also fatty acid sulfonates, $\alpha$-hydroxypropionic acid, alkali metal malonates, fatty acid sulfonates, alkyl and alkenyl disuccinates, tartaric acid diacetate, tartaric acid monoacetate, oxidized starch, and polymeric builders, for example polycarboxylates and polyaspartic acid.

Examples of organic builders are especially polymers and copolymers. In one embodiment of the present invention, organic builders are selected from polycarboxylates, for example alkali metal salts of (meth)acrylic acid homopolymers or (meth)acrylic acid copolymers.

Suitable comonomers are monoethylenically unsaturated dicarboxylic acids such as maleic acid, fumaric acid, maleic anhydride, itaconic acid and citraconic acid. A suitable polymer is in particular polyacrylic acid, which preferably has an average molecular weight $M_w$ in the range from 2000 to 40 000 g/mol, preferably 2000 to 10 000 g/mol, in particular 3000 to 8000 g/mol. Also of suitability are copolymeric polycarboxylates, in particular those of acrylic acid with methacrylic acid and of acrylic acid or methacrylic acid with maleic acid and/or fumaric acid, and in the same range of molecular weight.

It is also possible to use copolymers of at least one monomer from the group consisting of monoethylenically unsaturated $C_3$-$C_{10}$-mono- or $C_4$-$C_{10}$-dicarboxylic acids or anhydrides thereof, such as maleic acid, maleic anhydride, acrylic acid, methacrylic acid, fumaric acid, itaconic acid and citraconic acid, with at least one hydrophilic or hydrophobic monomer as listed below.

Suitable hydrophobic monomers are, for example, isobutene, diisobutene, butene, pentene, hexene and styrene, olefins with 10 or more carbon atoms or mixtures thereof, such as, for example, 1-decene, 1-dodecene, 1-tetradecene, 1-hexadecene, 1-octadecene, 1-eicosene, 1-docosene, 1-tetracosene and 1-hexacosene, $C_{22}$-$\alpha$-olefin, a mixture of $C_{20}$-$C_{24}$-$\alpha$-olefins and polyisobutene having on average 12 to 100 carbon atoms per molecule.

Suitable hydrophilic monomers are monomers with sulfonate or phosphonate groups, and also nonionic monomers with hydroxyl function or alkylene oxide groups. By way of example, mention may be made of: allyl alcohol, isoprenol, methoxypolyethylene glycol (meth)acrylate, methoxypolypropylene glycol (meth)acrylate, methoxypolybutylene glycol (meth)acrylate, methoxypoly(propylene oxide-co-ethylene oxide) (meth)acrylate, ethoxypolyethylene glycol (meth)acrylate, ethoxypolypropylene glycol (meth)acrylate, ethoxypolybutylene glycol (meth)acrylate and ethoxypoly (propylene oxide-co-ethylene oxide) (meth)acrylate. Polyalkylene glycols here may comprise 3 to 50, in particular 5 to 40 and especially 10 to 30 alkylene oxide units per molecule.

Particularly preferred sulfonic-acid-group-containing monomers here are 1-acrylamido-1-propanesulfonic acid, 2-acrylamido-2-propanesulfonic acid, 2-acrylamido-2-methylpropanesulfonic acid, 2-methacrylamido-2-methylpropanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 2-sulfoethyl methacrylate, 3-sulfopropyl methacrylate, sulfomethacrylamide, sulfomethylmethacrylamide, and salts of said acids, such as sodium, potassium or ammonium salts thereof.

Particularly preferred phosphonate-group-containing monomers are vinylphosphonic acid and its salts.

A further example of builders is carboxymethyl inulin.

Moreover, amphoteric polymers can also be used as builders.

Detergent compositions comprised in inventive containers may comprise, for example, in the range from in total 10 to 70% by weight, preferably up to 50% by weight, of builder. In the context of the present invention, chelating agent (C) is not counted as builder.

In one embodiment of the present invention, such detergent compositions comprised in inventive containers may comprise one or more cobuilders.

Detergent compositions comprised in inventive containers may comprise one or more anti-foams, selected for example from silicone oils and paraffin oils. In one embodiment of the present invention, detergent compositions comprised in inventive containers compositions comprise in total in the range from 0.05 to 0.5% by weight of antifoam.

Detergent compositions comprised in inventive containers may comprise one or more enzymes.

Examples of enzymes are lipases, hydrolases, amylases, proteases, cellulases, esterases, pectinases, lactases and peroxidases.

In one embodiment of the present invention, detergent compositions comprised in inventive containers may comprise, for example, up to 5% by weight of enzyme, preference being given to 0.1 to 3% by weight. Said enzyme may be stabilized, for example with the sodium salt of at least one $C_1$-$C_3$-carboxylic acid or $C_4$-$C_{10}$-dicarboxylic acid. Preferred are formates, acetates, adipates, and succinates.

In one embodiment of the present invention, detergent compositions comprised in inventive containers comprise at least one zinc salt. Zinc salts can be selected from water-soluble and water-insoluble zinc salts. In this connection, within the context of the present invention, water-insoluble is used to refer to those zinc salts which, in distilled water at 25° C., have a solubility of 0.1 g/l or less. Zinc salts which have a higher solubility in water are accordingly referred to within the context of the present invention as water-soluble zinc salts.

In one embodiment of the present invention, zinc salt is selected from zinc benzoate, zinc gluconate, zinc lactate, zinc formate, $ZnCl_2$, $ZnSO_4$, zinc acetate, zinc citrate, $Zn(NO_3)_2$, $Zn(CH_3SO_3)_2$ and zinc gallate, preferably $ZnCl_2$, $ZnSO_4$, zinc acetate, zinc citrate, $Zn(NO_3)_2$, $Zn(CH_3SO_3)_2$ and zinc gallate.

In another embodiment of the present invention, zinc salt is selected from ZnO, ZnO.aq, $Zn(OH)_2$ and $ZnCO_3$. Preference is given to ZnO.aq.

In one embodiment of the present invention, zinc salt is selected from zinc oxides with an average particle diameter (weight-average) in the range from 10 nm to 100 μm.

The cation in zinc salt can be present in complexed form, for example complexed with ammonia ligands or water ligands, and in particular be present in hydrated form. To simplify the notation, within the context of the present invention, ligands are generally omitted if they are water ligands.

Another aspect of the present invention is directed towards the use of inventive containers for dishwashing or laundry cleaning, especially as single unit dose. Dishwashing and laundry cleaning may refer to home care or to industrial and institutional applications, home care applications being preferred. Particularly preferred is automatic dishwash in home care applications.

Another aspect of the present invention is the use of an inventive aqueous formulation for manufacture of a gel useful for automatic dishwashing.

Another aspect of the present invention is directed towards a process for making inventive aqueous formulations. In the context of the present invention, said process may hereinafter also be referred to as inventive process. The inventive process comprises at least two steps, in the context of the present invention also being referred to as step (a) and step (b), (a) providing a mixture of at least one dispersant (B) and at least one pigment (A) or at least one dyestuff (A) with water (D), (b) mixing with at least one chelating agent (C).

Dispersant (B), chelating agent (C), water (D), dyestuff (A) and pigment (A) have been defined above.

Mixtures of at least one dispersant (B) and at least one pigment (A) or at least one dyestuff (A) with water (D) according to step (a) are preferably provided as a mixture of a dyestuff preparation or a pigment preparation in water. A dyestuff preparation is preferably made by mixing the respective dyestuff (A) and the respective dispersant (B) in a weight ratio in the range of from 3:1 to 1:5, preferably 2.5:1 to 1:2 and even more preferably 1.6:1 to 1:1.1 and some water (D) in a mill, for example in a ball mill. A pigment preparation is preferably made by mixing the respective pigment (A) and the respective dispersant (B) in a weight ratio in the range of from 3:1 to 1:5, preferably 2.5:1 to 1:2 and even more preferably 1.6:1 to 1:1.1 and some water (D) in a mill, for example in a ball mill. The term "some water" in the context with making mixtures of at least one dispersant (B) and at least one pigment (A) or at least one dyestuff (A) with water (D) means up to 50% by weight, referring to the total mixture.

In a preferred embodiment, the average diameter of pigments (A) is typically in the range from 20 nm to 1.5 μm and preferably in the range from 100 to 300 nm after mixing in said mill.

The respective dyestuff preparation or pigment preparation is then mixed with water (D), for example in the ratio of 1:10 to 1:1,000. Said mixing may also be considered a diluting. Said diluting may be carried out at ambient temperature or at a temperature in the range of from 23 to 50° C.

Step (a) may be carried out in any vessel. Preferred are vessels that have a mixing device, for example a stirrer.

The order of addition—water (D) and dyestuff preparation or pigment preparation—is not critical, however, it is preferred to first charge a vessel with dyestuff preparation or pigment preparation and to then add water (D).

In one embodiment of the present invention, the duration of step (a) is in the range of from 1 minute to 10 hours, preferred are 5 minutes to 1 hours.

In a special embodiment, step (a) includes one or more sub-steps, for example a drying step, preferably a spray-drying step.

In step (b), the mixture obtained in step (a) is mixed with at least one chelating agent (C). It is preferred to charge a vessel with a solution containing such at least one chelating agent (C) and then adding mixture (a). Said addition may be effected at ambient temperature or at a temperature in the range of from 23 to 50° C. or at lower temperature, for example 5 to 19° C.

Chelating agent (C) may be added as solid, for example as powder or granule or compactate, or as aqueous solution, the addition in the form of an aqueous solution being preferred. In embodiments wherein chelating agent (C) is added as solid, it is preferred to add water (D).

In one embodiment of the present invention, the duration of step (b) is in the range of from 1 minute to 10 hours, preferred are 5 minutes to 1 hour.

By carrying out the inventive process, aqueous formulations according to the present invention are being obtained.

The invention is further illustrated by working examples.

I. MANUFACTURE OF INVENTIVE AQUEOUS FORMULATIONS

General remark: The following substances were used:

(A.1): CI Pigment Blue 15:1

(A.2): CI Acid Blue 9

(B2.1): polycondensate of β-naphthalenesulfonic acid sodium salt, and formaldehyde, molar ratio about 1:1, molecular weight $M_w$ 5,700 g/mol, determined by GPC using a mixture of 60% by weight of 0.1 mol/l aqueous $NaNO_3$ solution, 30% by weight of tetrahydrofurane (THF) and 10% by weight of acetonitrile as mobile phase and cross-linked hydroxyethylmethacrylate as stationary phase. As a standard, polymers of styrenesulfonic acid sodium salt and monomeric β-naphthalenesulfonic acid sodium salt were used.

(C.1): MGDA-$Na_3$, (35% ee referring to the L-enantiomer), used as 40% by weight aqueous solution.

I.1 Manufacture of Inventive Aqueous Formulation (AF.1)

Step (a.1): a mixture was provided by combining 40 g of pigment (A.1) and 55 g of dispersant (B2.1) and 5 g of $Na_2SO_4$ and 95 g of water (D) in a ball mill, followed by water removal by rotary evaporation, bath temperature 80° C., 8 hours. An amount of 0.2 g of the resultant mixture was diluted with 10 g of distilled water.

Step (b.1): 0.5 g of the mixture obtained in step (a.1) were mixed with 100 g of 40% by weight solution of (C.1). Inventive aqueous formulation (AF.1) was obtained. Its pH value was 11, determined as 1% by weight aqueous solution.

I.2 Manufacture of Comparative Aqueous Formulation C-(AF.2)

Step (a.2): An aqueous solution containing (A.2) was prepared by adding 10 grams of distilled water (D) to a 0.2 gram of dyestuff (A.2).

Step (b.2): 0.5 grams solution resulting from step (a.2) were added to 100 gram of 40% by weight solution of (C.1).

For comparison purposes, the mixtures according to step (a.1) and (a.2) were each diluted with 80 g of water instead of solution of (C.1). Comparative aqueous formulations C-(AF.3) and C-(AF.4) were obtained.

II. Tests Of Color Stability

The color intensity was measured directly after manufacture, 1 day after manufacture and 7 days after manufacture. The measurements were performed at visible light at 23° C. and UV light, wavelength 366 nm, at 28° C. The evaluation was performed according to CIELAB.

TABLE 1

| color stability measured with visible light | | | | | | | | | |
|---|---|---|---|---|---|---|---|---|---|
| | 1 min after manufacture | | | 1 d after manufacture | | | 7 d after manufacture | | |
| | L* | a* | b* | L* | a* | b* | L* | a* | b* |
| (AF.1) | 52.6 | −54.8 | −31.3 | 52.3 | −53.2 | −31.5 | 51.9 | −53.8 | −32.0 |
| C-(AF.2) | 59.9 | −40.9 | −44.2 | 48.5 | −47.6 | −61.4 | 86.3 | 13.6 | −12.3 |
| C-(AF.3) | 52.9 | −46.2 | −39.1 | 52.7 | −44.2 | −40.8 | 52.7 | −44.3 | −40.8 |
| C-(AF.4) | 56.9 | −19.6 | −61.3 | 56.5 | −17.9 | −62.2 | 56.5 | −17.7 | −62.4 |

L*: Lightness value, may be in the range of from 0 to 100. 0: ideal black. 100: ideal white

TABLE 2

| color stability tests with UV light, wavelength 366 nm | | | | | | | | | |
|---|---|---|---|---|---|---|---|---|---|
| | 1 min after manufacture | | | 1 d after manufacture | | | 7 d after manufacture | | |
| | L* | a* | b* | L* | a* | b* | L* | a* | b* |
| (AF.1) | 52.6 | −54.8 | −31.3 | 52.3 | −53.2 | −31.5 | 54.5 | −49.9 | −32.0 |
| C-(AF.2) | 59.9 | −40.9 | −44.2 | 93.1 | −1.0 | 7.1 | 95.9 | −0.9 | 3.6 |
| C-(AF.3) | 52.9 | −46.2 | −39.1 | 52.5 | −45.4 | −39.4 | 51.5 | −46.8 | −37.4 |
| C-(AF.4) | 56.9 | −19.6 | −61.3 | 56.3 | −17.9 | −62.2 | 56.5 | −17.8 | −62.4 |

The colour of the inventive aqueous formulation remained brilliant while the comparative aqueous formulations either showed drastic fading of their colour or even turned pale purple.

The invention claimed is:

1. An aqueous formulation, comprising:

at least one pigment or at least one dyestuff, (A) at least one dispersant selected from the group consisting of (B1) a copolymer of at least one ethylenically unsaturated $C_4$-$C_{10}$-dicarboxylic acid and at least one $C_4$-$C_{20}$-olefin, and respective alkali metal salts, and (B2) an aromatic sulfonic acid and respective alkali metal salts (B) at least one chelating agent selected from the group consisting of MGDA, GLDA, IDS and citric acid and their respective ammonium and alkali metal salts, and (C) water, wherein:

a concentration of the pigment (A) or dyestuff (A) is in the range of from 5 to 500 ppm, referring to the total aqueous formulation; and a weight ratio of the dispersant (B) to the pigment (A) or dyestuff (A), respectively, is in the range of from 1:5 to 3:1.

2. The aqueous formulation according to claim 1, wherein said formulation has a pH value in the range of from 8 to 14.

3. The aqueous formulation of claim 1, wherein said formulation is free from enzyme.

4. The aqueous formulation of claim 1, wherein said chelating agent (C) is selected from the group consisting of MGDA and GLDA and their respective alkali metal salts.

5. The aqueous formulation of claim 1, wherein said chelating agent (C) is a mixture of L- and D-enantiomers of methyl glycine diacetic acid (MGDA) or its respective mono-, di or trialkali metal or mono-, di- or triammonium salts, said mixture containing predominantly the respective L-isomer with an enantiomeric excess (ee) in the range of from 10 to 75%.

6. The aqueous formulation of claim 1, having a total solids content in the range of from 10 to 60% by weight.

7. The aqueous formulation of claim 1, wherein the dispersant (B) comprises an alkali metal salt of naphthalene sulfonic acids that may have been reacted with formaldehyde as the dispersant (B2).

8. The aqueous formulation of claim 1, wherein the dispersant (B) comprises the copolymer (B 1) in which the at least one $C_4$-$C_{20}$-olefin is diisobutene.

9. A transparent or translucent container containing the aqueous formulation of claim 1.

10. The container according to claim 9, wherein said container is made from polyvinyl alcohol.

11. The container of claim 9, wherein said container is a di-, tri- or multi-compartment container of which one compartment contains the aqueous formulation and the other compartment(s) do not.

12. The container of claim 9, wherein said container is a di- or tri- or multi-compartment pouch of which one compartment contains the aqueous formulation and the other compartment(s) do not.

13. A single unit dose for laundry cleaning or automatic dishwashing, the single unit dose comprising the container of claim 9.

14. A gel for automatic dishwashing, wherein the gel is formed from the aqueous formulation of claim 1.

15. A process for making an aqueous formulation according to claim 1, the process comprising mixing at least one chelating agent (C) with a mixture comprising at least one dispersant (B), at least one pigment (A) or at least one dyestuff (A), and water (D).

* * * * *